US007670192B2

(12) United States Patent
Wu

(10) Patent No.: US 7,670,192 B2
(45) Date of Patent: Mar. 2, 2010

(54) AUDIO PLUG

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/157,019

(22) Filed: Jun. 6, 2008

(65) Prior Publication Data

US 2009/0305573 A1 Dec. 10, 2009

(51) Int. Cl.
*H01R 24/04* (2006.01)

(52) U.S. Cl. ..... 439/669; 439/447; 439/936

(58) Field of Classification Search ..... 439/669, 439/447, 936, 668, 901, 589
See application file for complete search history.

(56) References Cited

U.S. PATENT DOCUMENTS 3,626,360 A 12/1971 Edward
5,139,444 A * 8/1992 Garay et al. ..... 439/668
5,290,179 A 3/1994 Weingartner
6,102,724 A * 8/2000 Ring ..... 439/320
6,126,465 A * 10/2000 Franks, Jr. ..... 439/218
6,394,852 B1 * 5/2002 Huang ..... 439/669
6,439,933 B1 8/2002 Moji
6,550,978 B2 * 4/2003 De Marchi ..... 385/60
6,582,248 B2 * 6/2003 Bachman ..... 439/462
6,786,774 B2 * 9/2004 Haas et al. ..... 439/669

* cited by examiner

*Primary Examiner*—T C Patel
*Assistant Examiner*—Harshad C Patel
(74) *Attorney, Agent, or Firm*—Wei Te Chung; Andrew C. Cheng; Ming Chieh Chang

(57) ABSTRACT

An audio plug (100) for a connection with an audio plug, includes a contact shaft (1) for a connection with the audio plug and a cable (5), a tubular sleeve (2) covering on the contact shaft, and a metal tube (4) glued on the tubular sleeve. Wherein the tubular sleeve has a plurality of channels (21, 22) on the external face thereof for accommodating glue.

6 Claims, 9 Drawing Sheets

AUDIO PLUG

BACKGROUND OF THE INVENTION

1. Field of the Invention

The present invention relates to an audio plug and, more particularly, an audio plug with a contact shaft for an electrical connection of an electrical conductor, and a metal tube provided on the contact shaft.

2. Description of Prior Arts

A great number of audio plugs of the most varied constructions are known. These numerous constructional forms are disclosed in many publications.

U.S. Pat. No. 5,290,179 discloses an audio plug comprising primarily a tubular shaft served as an external contact, a bushing having a greater diameter than the shaft and covering on the shaft, and a gripping sleeve receiving the bushing and the shaft. The bushing which carries an external thread adjacent to the aforementioned shaft is slid onto the shaft. The gripping sleeve with a central bore hole for a passage of a cable. One end of the gripping sleeve has an internal thread by which the gripping sleeve can be screwed onto the thread of the bushing and covers the aforementioned shaft.

However, such previously known constructions are proper to be used in a larger electronic device. When a small audio plug is needed, it is difficult to design precise threads on the bushing and the gripping sleeve. Moreover, the gripping sleeve, to the extent that it is constructed in one piece and is made of harder material, extends over the cable in a cantilevering manner. Since there is no soft cooperation at the end of the gripping sleeve to accommodate the cable, the cable can only exert a limited distortion. If the cable extends or twists, one end thereof connecting with the gripping sleeve will be broken in two parts. Then a desirable transmission between the audio plug and the electronic device will be broken.

Therefore, the present invention is directed to solving these various problems by providing an improved cable connector.

SUMMARY OF THE INVENTION

An object, therefore, of the invention is to provide an audio plug in a minimize and capable of achieving a desirable connection between the audio plug and an electronic device.

In the exemplary embodiment of the invention, an audio plug for a connection with an audio jack, includes a contact shaft for a connection with the audio jack and a cable, a tubular sleeve covering on the contact shaft, and a metal tube glued on the tubular sleeve. Wherein the tubular sleeve is formed a plurality of channels on the external face thereof for accommodating glue.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
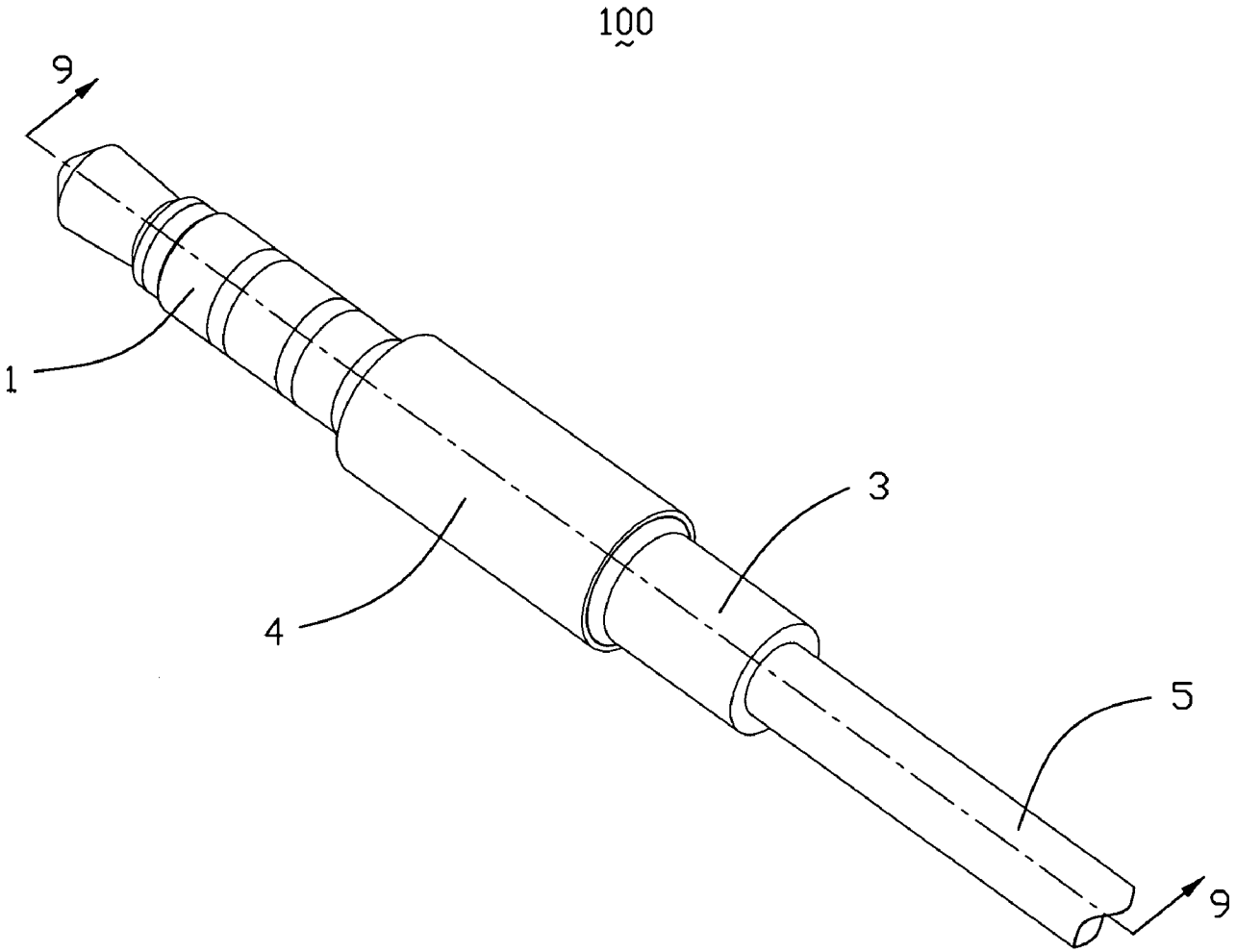
FIG. 1 is a perspective view of an audio plug of present invention.
Figure 2:
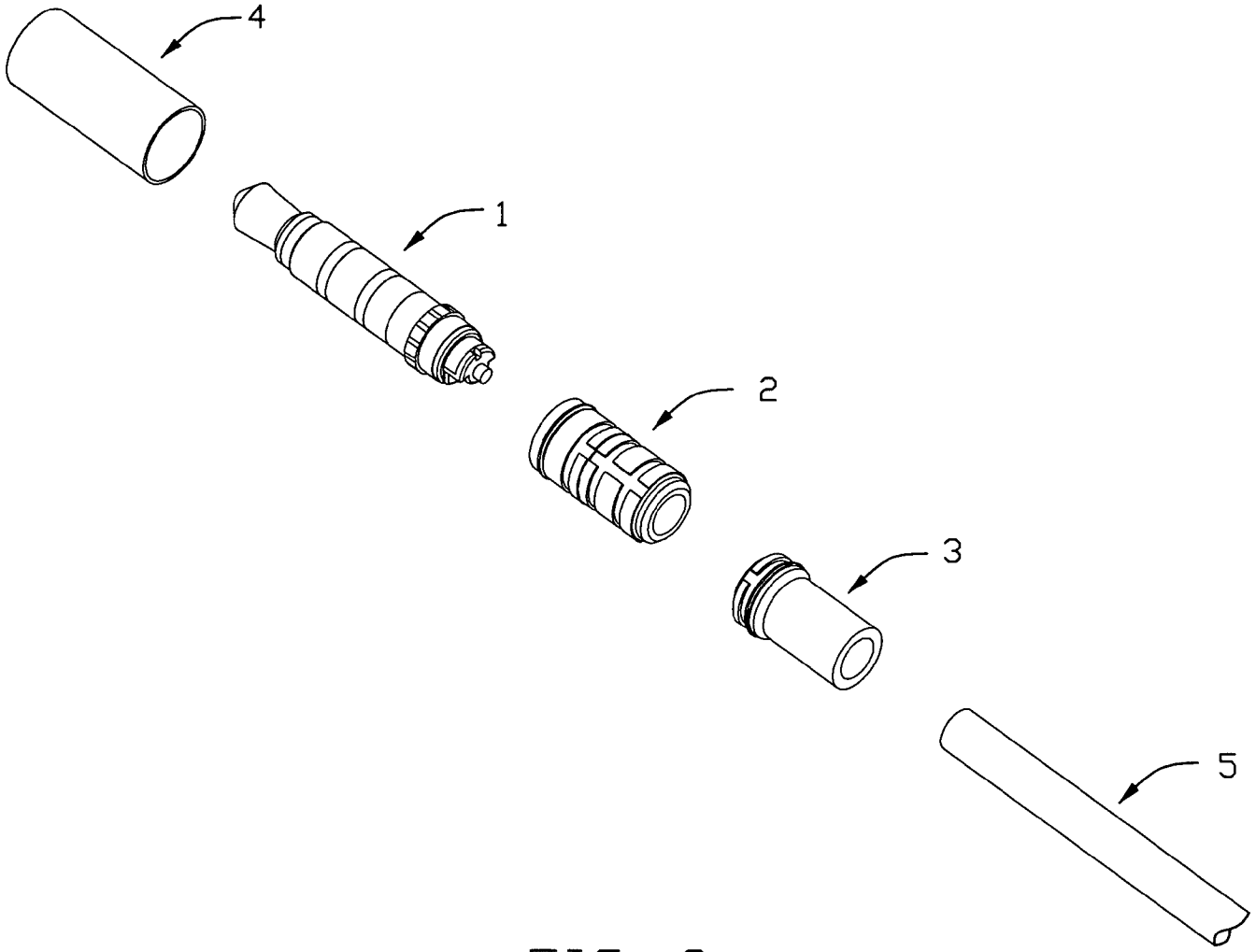
FIG. 2 is an exploded view of the audio plug of present invention as shown in FIG. 1.

Referring to FIG. 1 to FIG. 9, the present invention provides an audio plug 100 for a connection to an electrical conductor (not shown), such as an audio jack. The audio plug 100 comprises a contact shaft 1, a tubular sleeve 2, a bushing 3, a metal tube 4, and a cable 5. One end of the contact shaft 1 is received in the tubular sleeve 2 to link with the cable 5, and the other end is served to connect with an electrical conductor. The tubular sleeve 2 and the bushing 3 engage with each other face to face thereafter to receive an association of the contact shaft 1 and the cable 5. The metal tube 4 is glued on the tubular sleeve 2 and the bushing 3. In a side view, the bushing 3 is visible, and the tubular sleeve 2 is covered completely.

Figure 3:
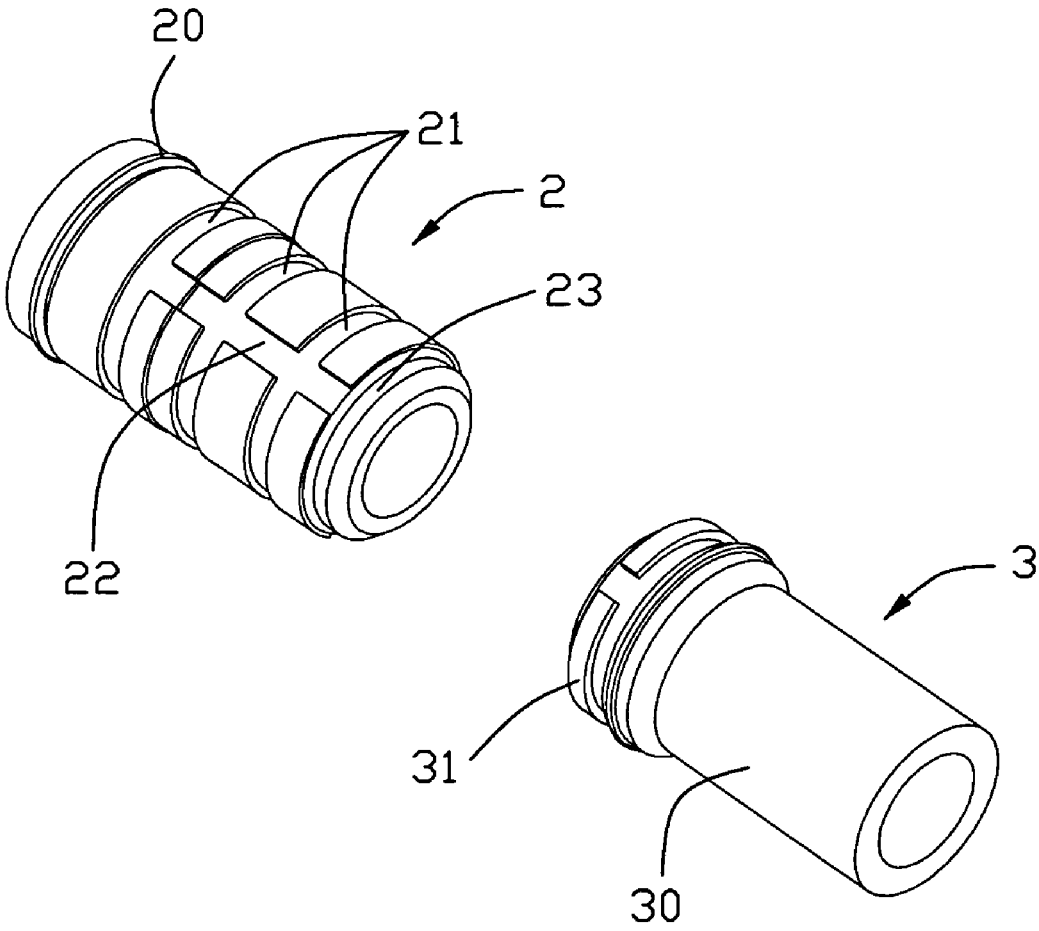
FIG. 3 is a perspective view of a tubular sleeve and a bushing of the plug as shown in FIG. 2.
Figure 4:
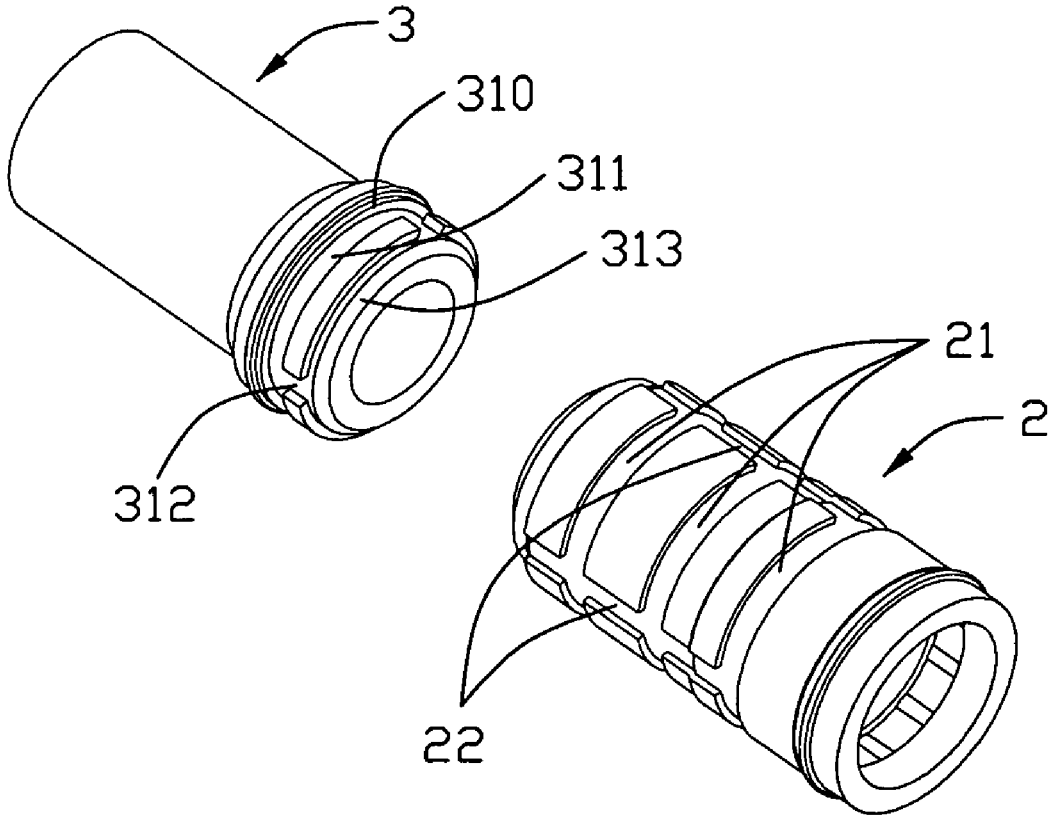
FIG. 4 is a perspective view of the tubular sleeve and the bushing as shown in FIG. 3 in another aspect.
Figure 5:
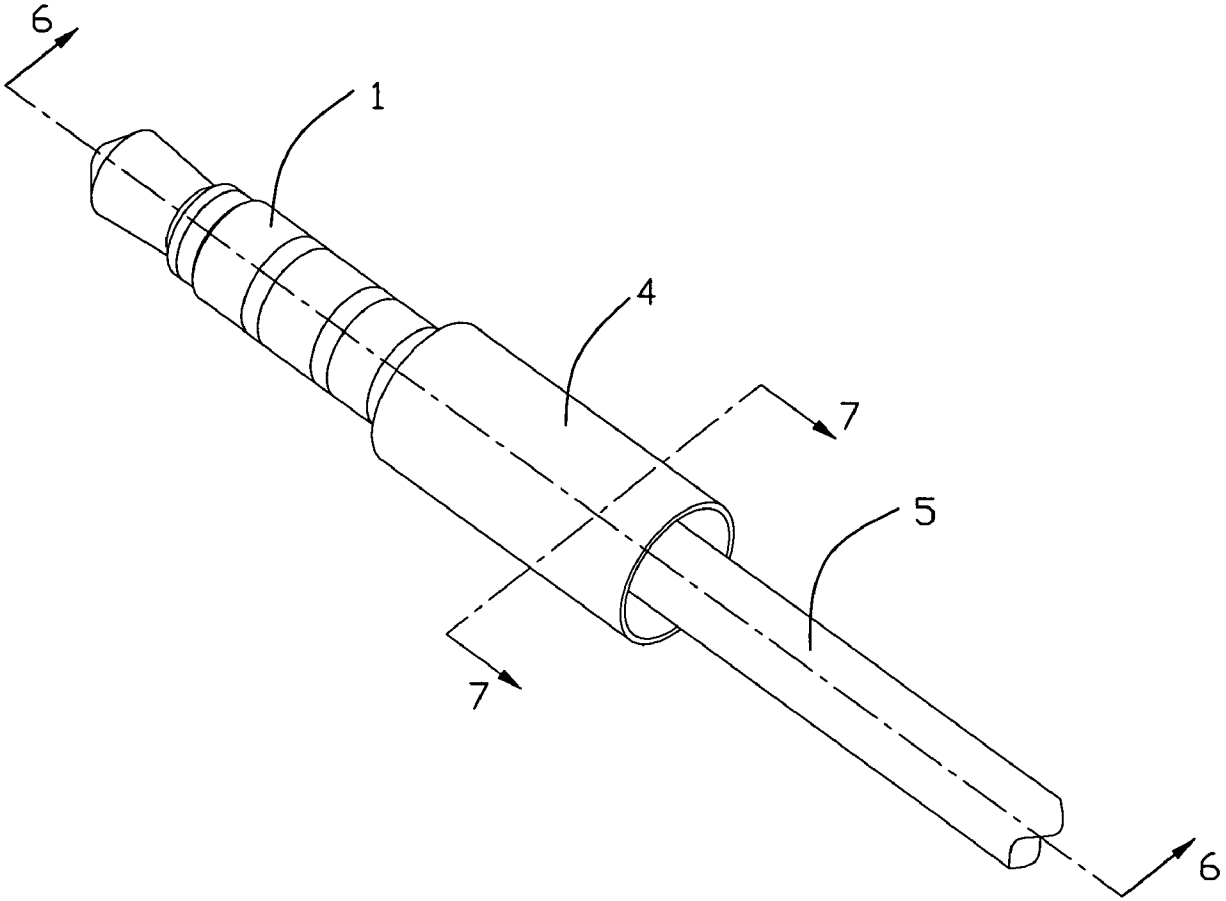
FIG. 5 is a perspective view of the audio plug when the bushing is taken off.
Figure 6:
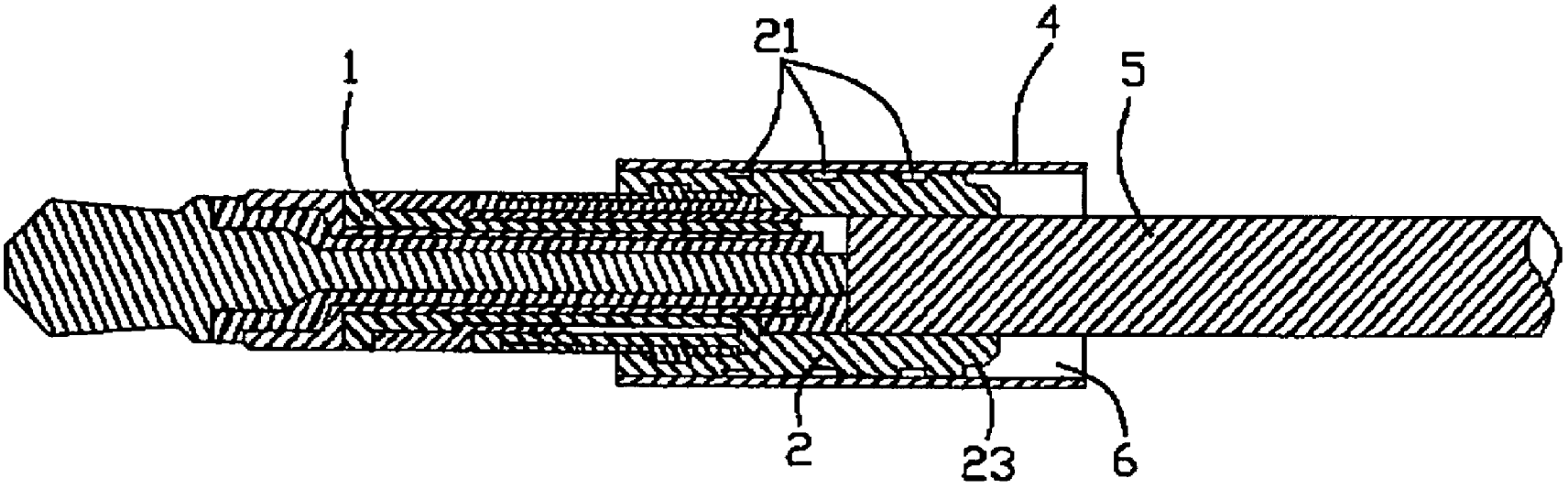
FIG. 6 is a cross-sectional view of the audio plug shown in FIG. 5 taken along line 6-6.
Figure 7:
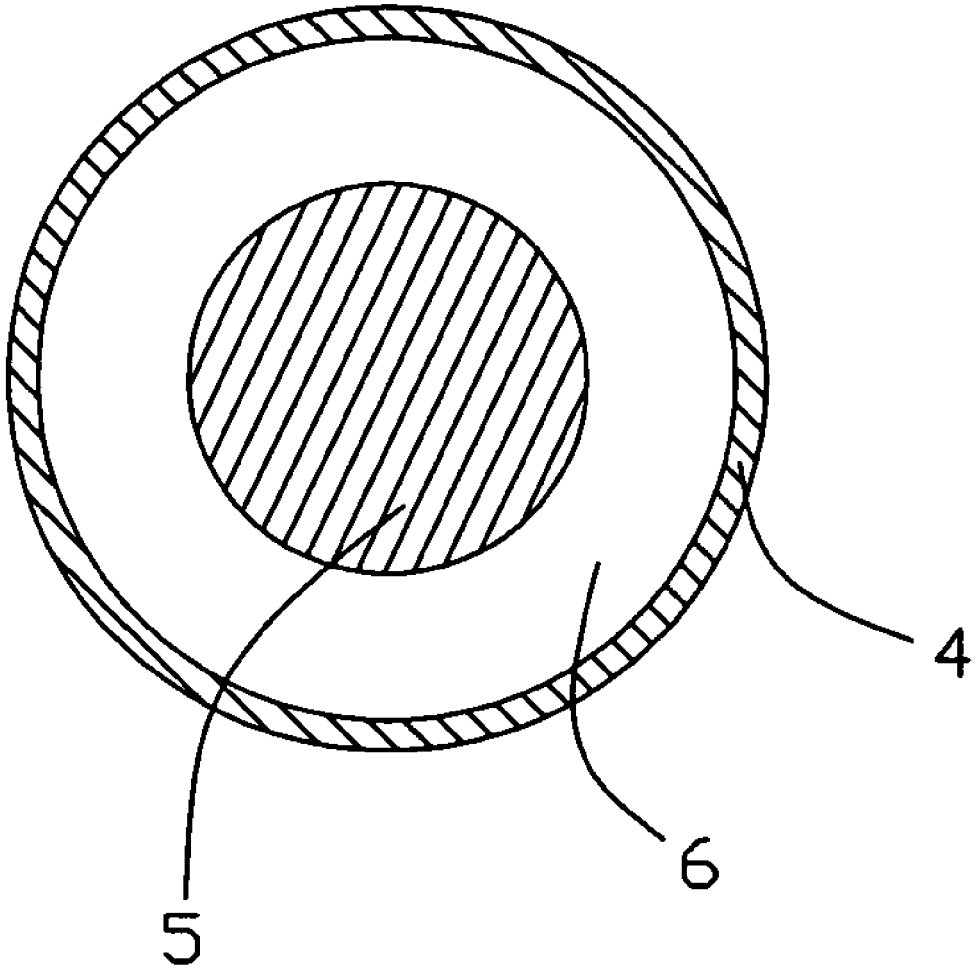
FIG. 7 is a cross-sectional view of the audio plug shown in FIG. 5 taken along line 7-7.
Figure 8:
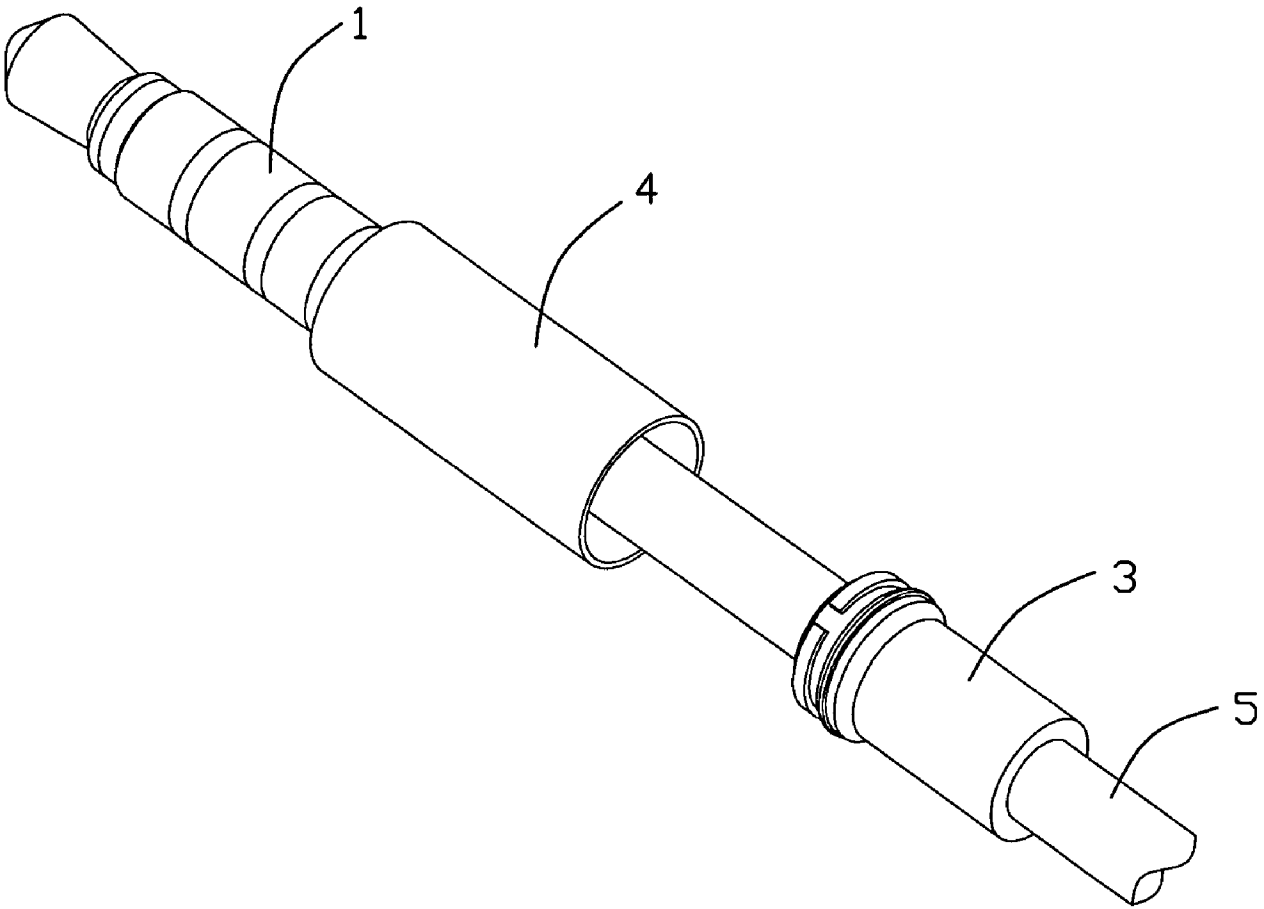
FIG. 8 is the audio jack as shown in FIG. 5 with the bushing.
Figure 9:
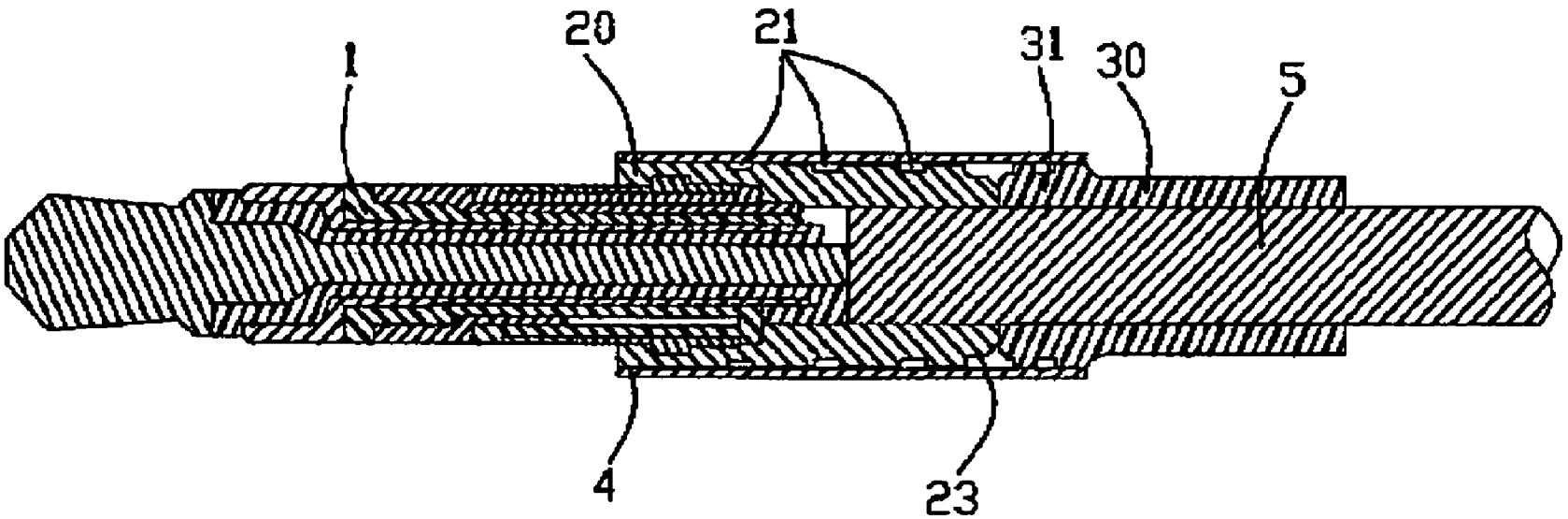
FIG. 9 is a cross-sectional view of the audio plug as shown in FIG. 1 taken along line 9-9.

As shown in FIG. 3 and FIG. 4, the bushing 3 is preferably made of plastic or soft material and easy to deform to prevent cable jacket (not labeled) bare when the cable 5 bend and twist, and comprises a fitting portion 31 and an extended portion 30. The fitting portion 31 has a plurality of first transverse channels 312, a first annular channel 311 for glue to flow or stay, a first annular header 313 for glue to flow and a first annular wall 310 for fitting with the inner face of the metal tube 4 to prevent glue leakage. The first transverse channel 312 and the first annular channel 311 communicate with each other in a crossed manner. The fitting portion 31 and the extended portion 30 are separated by the first annular wall 310. Moreover, the bushing 3 has a flat inner face for the cable 5 sliding therein easily.

Referring to FIG. 3 primarily, the tubular sleeve 2 is preferably made of harder material to protect solder joint, and has a plurality of second transverse channels 22 according with the first transverse channels 312 of the bushing 3, a plurality of second annular channels 21 for glue to flow or stay, a second annular wall 20, and a second annular header 23 for glue to flow. The second transverse channel 22 and the second annular channel 21 communicate with each other in a crossed manner. The second annular wall 20 is formed on one head of the tubular sleeve 2 away from the bushing 3, and the other head of the tubular sleeve 2 is capable of connecting with one head of the bushing 3 tightly.

The metal tube 4 has a flat inner face and is glued on the bushing 3 and the tubular sleeve 2 hermetical. Besides, the metal tube 4 has a length that is equivalent to that of the tubular sleeve 2 and the fitting portion 31 of the bushing 3. The inner diameter of the metal tube 4 corresponds to the external diameter of the tubular sleeve 2 and the bushing 3.

Together with FIG. 5 to FIG. 9, the relationship between the elements of the audio plug 100 as described above will be illustrated in following segments.

The contact shaft 1 and the cable 5 join with each other with the tubular sleeve 2 covering thereon, and further that the metal tube 4 slides on the tubular sleeve 2 with a space 6 left therebetween allowing glue to flow and stay in the space 6, the second transverse channel 22, the second annular channels 21 and the second annular header 23, and further that the busing 3 slides on the cable 5 to the space 6 till engaging with the tubular sleeve 2 tightly to provide strain relief for the cable, then glue also flow and stay in the first transverse channel 312, the first annular channel 311, and the first annular header 313. The first annular wall 310 and the second annular wall 20 fit with the inner face of the metal tube 4 airtightly to prevent glue leakage. Thus the entire plug has been assembled.

It can be seen from the foregoing description and from the attached drawings that the metal tube 4 is glued on the tubular sleeve 2 and the bushing 3 tightly with some channels formed thereon for glue to flow and stay instead of being screwed thereon by means of internal threads on the inner face of the metal tube and external threads on the external face of the tubular sleeve 2 and the bushing 3. On the other hand, the bushing 3 is made of soft material having an amortizable force and allows the cable 5 to bend and twist but not to be damaged. Particularly, a minimize audio plug can be achieved with such construction, and a simple module also can be manufactured without a precise thread thereon. Furthermore, the first annular wall 310 and the second annular wall 20 can prevent a leakage of glue.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An audio plug for connection with an audio jack, comprising:

a contact shaft for a connection with the audio jack and a cable;

a tubular sleeve covering on the contact shaft;

a metal tube glued on the tubular sleeve; and a bushing connecting with the tubular sleeve end to end and partially received in the metal tube tightly; wherein the tubular sleeve has a plurality of channels on the external face thereof for accommodating glue; wherein each of the tubular sleeve and the bushing comprises an annular wall on each external face to fit with the inner surface of the metal tube tightly and prevent a leakage of glue.

2. The audio plug as claimed in claim 1, wherein one end of the bushing connecting with the tubular sleeve is covered by the metal tube tightly and the other end is visible in a side view.

3. The audio plug as claimed in claim 2, wherein the bushing comprises a plurality of channels corresponding to the channels of the tubular sleeve.

4. The audio plug as claimed in claim 3, wherein the channels of each of the tubular sleeve and the bushing comprises a plurality of transverse channels and a plurality of annular channels communicating with the transverse channels in a crossed manner.

5. The audio plug as claimed in claim 1, wherein the bushing is made of deformable material.

6. The audio plug as claimed in claim 5, wherein the tubular sleeve is made of a material harder than the deformable material of the bushing.

* * * * *